US005471223A

United States Patent [19]

McCorkle

[11] Patent Number: 5,471,223

[45] Date of Patent: Nov. 28, 1995

[54] LOW VSWR HIGH EFFICIENCY UWB ANTENNA

[75] Inventor: John McCorkle, Laurel, Md.

[73] Assignee: The United States of America as represented by the Secretary of the Army, Washington, D.C.

[21] Appl. No.: 160,304

[22] Filed: Dec. 1, 1993

[51] Int. Cl.[6] ..... H01Q 13/02

[52] U.S. Cl. ..... 343/786; 343/772

[58] Field of Search ..... 343/786; H01Q 13/02, H01Q13/00, 13/06

[56] References Cited

U.S. PATENT DOCUMENTS

| | | | |
|---|---|---|---|
| 3,406,398 | 10/1968 | Beguin | 343/786 |
| 3,831,176 | 8/1974 | Epis et al. | 343/756 |
| 4,217,549 | 8/1980 | Henoch | 343/78.6 X |
| 4,266,203 | 5/1981 | Saudreau et al. | 343/786 X |
| 4,320,404 | 3/1982 | Chekroun | 343/786 X |
| 4,571,593 | 2/1986 | Martinson | 343/786 X |
| 4,630,059 | 12/1986 | Maz | 343/786 X |
| 4,633,264 | 12/1986 | Imazeki et al. | 343/786 |

*Primary Examiner*—Donald Hajec
*Assistant Examiner*—Tho G. Phan
*Attorney, Agent, or Firm*—Freda L. Krosnick; Frank J. Dynda

[57] ABSTRACT

An antenna for radiating ultra wide bandwidth radio frequency pulses for use in communications systems and sensors is disclosed in which a TEM horn is loaded by a resistively loaded parallel plate section and a shunt network connected to the parallel plate section in order to provide a low VSWR high efficiency antenna.

10 Claims, 3 Drawing Sheets

LOW VSWR HIGH EFFICIENCY UWB ANTENNA

BACKGROUND OF THE INVENTION

The present invention relates generally to an antenna for radiating ultra wide bandwidth (UWB) radio frequency (RF) pulses for use in communications systems and sensors such as radars. More particularly, the present invention relates to an antenna for impulse radar.

As is known in the art, impulse radar is presently being used in a variety of radar systems in order to determine the location of aircraft, ground vehicles, people, mines, buried pipes, and faults in roadways, tunnels, leaking buried pipes, etc. However, a problem that arises in connection with the use of impulse radar is the reflection of the transmitted pulse by the transmitting antenna itself. That reflection causes an exponentially decaying oscillation as the pulse reflects back and forth between the transmitter and the antenna. In some instances, that oscillation can be so strong and last so long that it masks the intended target.

Although some common methods for minimizing the problem of transmitted pulse reflection by the transmitting antenna have been developed, such methods have been, to date, less than satisfactory. Common methods for minimizing that problem are to add a loss to the transmission line, add a loss to the antenna or to design a transmitter that will terminate the reflected wave. Adding losses to either the transmission line or the antenna have the disadvantage of wasting a portion of the transmitter power. Designing a transmitter to terminate the reflected wave has, to the present time, resulted in inefficient and bulky designs, which are unsatisfactory. Therefore, there still exists a need in the art for an antenna that minimizes losses while at the same time maintains high return loss.

SUMMARY AND OBJECT OF THE INVENTION

In view of the foregoing, it should be apparent that there still exists a need in the art for a method and apparatus for constructing an antenna that radiates efficiently yet terminates all energy put into it.

More particularly, it is an object of this invention to provide an antenna that minimizes losses while maintaining high return loss which has a particular application for use with impulse radar and which is simple and reliable to construct. Briefly described, these and other objects of the invention are accomplished by providing a certain network structure across the output of a transverse electromagnetic mode (TEM) horn which forms the antenna. The network which is added across the output of the horn consists of two parts. First, a resistively loaded parallel plate section and, second, a shunt network which consists of a shorting wire connected in series with a resistor at each end connecting the plates of the antenna. The parallel plate section of the network functions to launch the high frequency waves without reflecting any energy. The shunt network portion of the network functions as a distributed inductor having resistive loads which acts to terminate the low frequencies to be transmitted by the antenna so that low frequency waves do not reflect energy.

With these and other objects, advantages and features of the invention that may become hereinafter apparent, the nature of the invention may be more clearly understood by reference to the following detailed description of the invention, the appended claims and to the several drawings attached herein.

DETAILED DESCRIPTION OF THE PREFERRED EMBODIMENT

Figure 1:
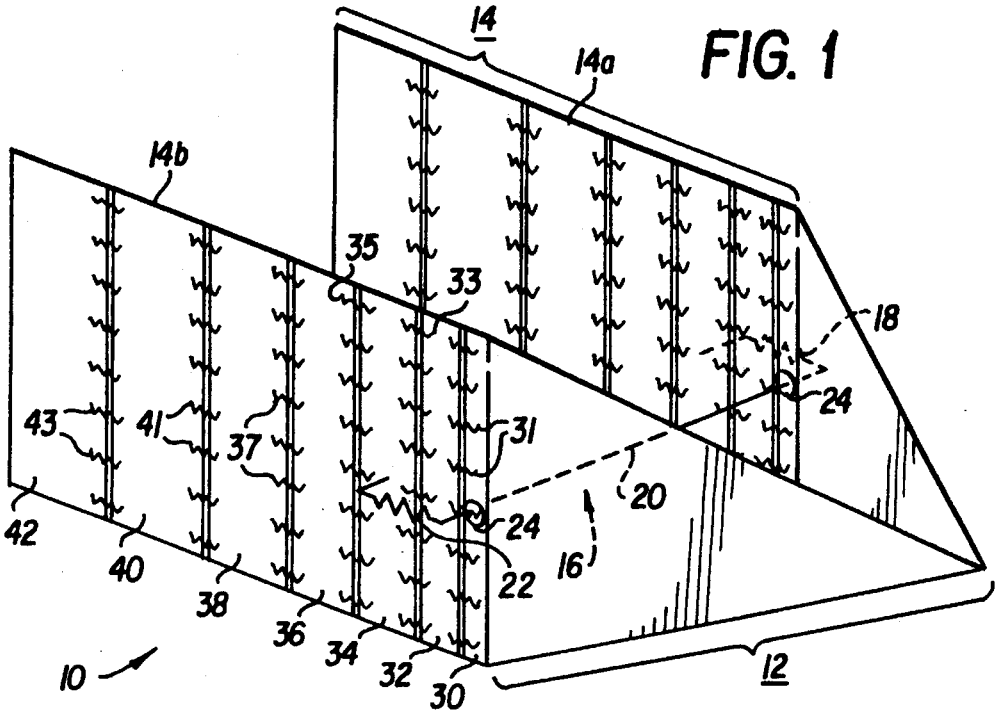
FIG. 1 is a diagram illustrating implementation of the invention on a TEM horn antenna.

Referring now in detail to the drawings wherein the like parts are designated by like reference numerals throughout, there is illustrated in FIG. 1 a preferred embodiment of the low voltage standing wave ratio (VSWR) high efficiency ultra wide bandwidth antenna 10 of the present invention. The UWB antenna 10 is constructed from a constant impedance TEM horn section 12 which may preferably be made from etched copper in a known manner. The horn shown and resistor values shown are for a 200 ohm surge impedance. The design can be scaled to other impedances. The horn section 12 is connected to a resistively loaded parallel plate section 14. The parallel plate section 14 is in turn connected to a shunt network 16. The shunt network 16 is formed by a length of wire 20, such as #22 magnet wire. The wire 20 passes through the apertures 24 located in each of the parallel plates which form the parallel plate section 14, in close proximity to the back end of the horn 12 of the antenna 10. Each of the apertures 24 is located at approximately the mid-point of the height of each of the parallel plates which form the parallel plate section 14.

A resistor 18 and a resistor 22 are connected respectively at each end of the wire 20. The other end of each of the resistors 18 and 22 is connected to its respective parallel plate **14*a* and 14*b*. Each of the resistors 18 and 22** may preferably be 82 ohm resistors for the 200 ohm antenna shown.

Each of the parallel plates **14*a* and 14*b* which make up the resistively loaded parallel plate section 14** are formed from a plurality of varying length sections which are connected to each other by a plurality of spaced resistors.

In the preferred embodiment, each of the parallel plates **14*a* and 14*b* may be formed as follows. The first section 30 of the plate 14*b* may be about ⅛ of an inch in length and is electrically connected to the horn section 12. The second section 32 of the plate section 14*b* may be ¾ of an inch and is connected by a plurality of, for example, eight resistors 31 to the first section 30. Each of the resistors 31 may preferably have a resistance of 37.4 ohms. The sections 30 and 32 are secured together but are electrically insulated from each other, using suitable means, such as glass epoxy adhesive. The third section 34 of the plate section 14*b* may preferably be 1¼ inches wide and is electrically connected by means of a plurality of resistors 33 to the second section 32. Each of the resistors 33 may preferably have a resistance of 90.9 ohms. Again, the sections 32 and 34** are connected but are otherwise insulated from each other by any suitable means.

Figure 6:
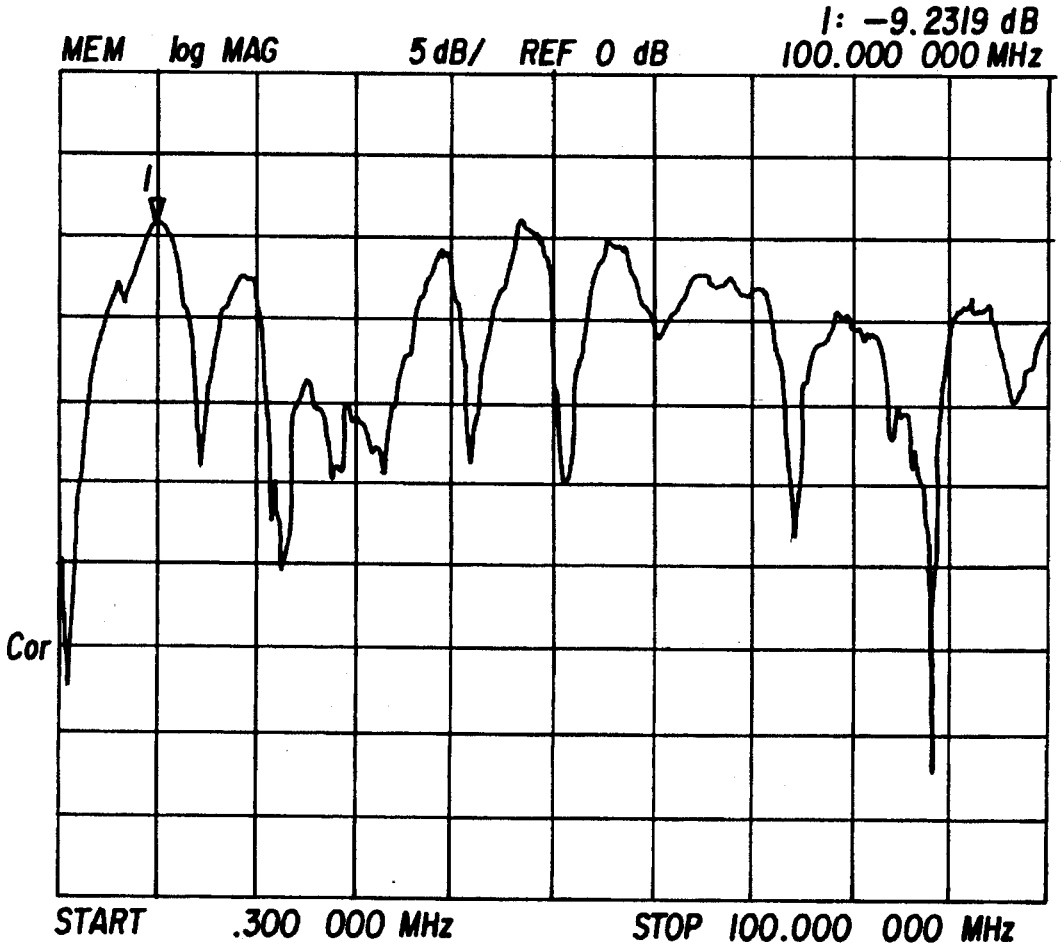
FIG. 6 shows a drawing of an S11 return loss versus frequency scan for the antenna of the present invention.
Figure 5:
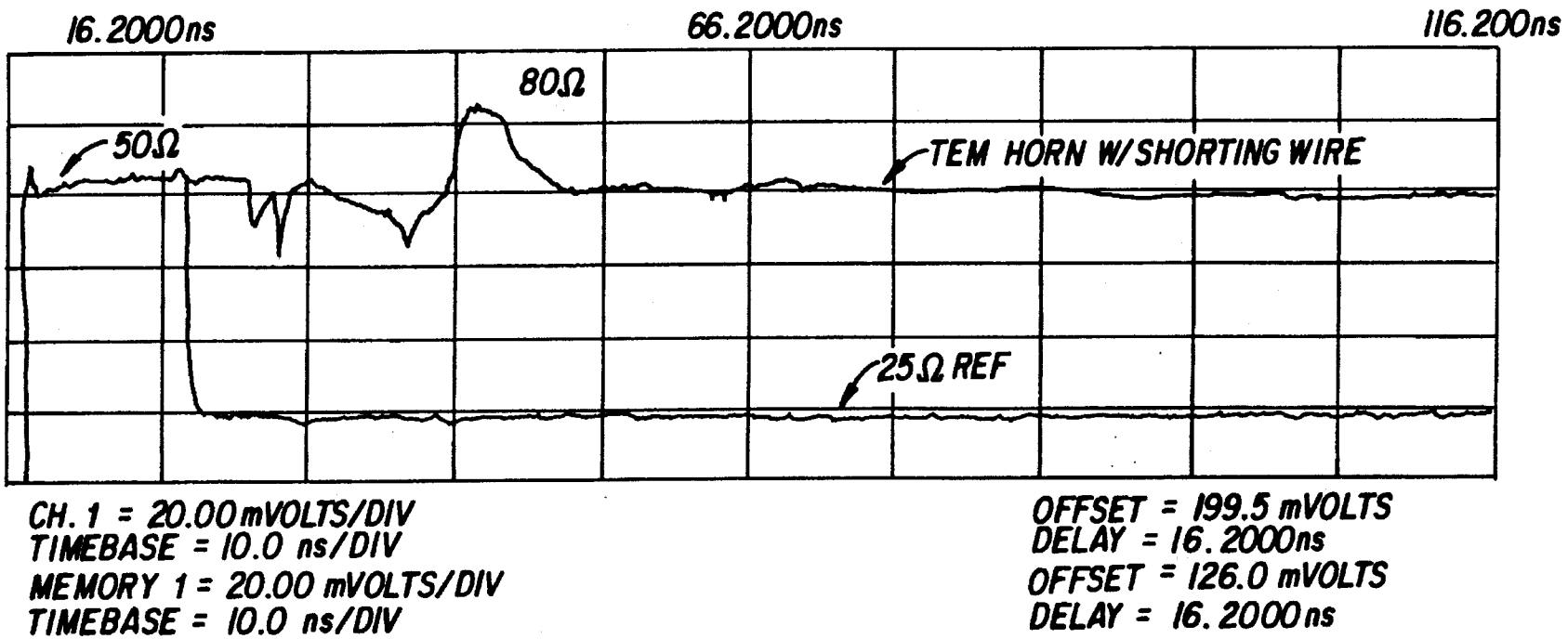
FIG. 5 is a drawing of the time domain reflectometer response of the antenna of FIG. 1.

In a similar manner, each of the remaining sections 36, 38, 40 and 42 of the plate section **14*b* preferably have lengths of 2 inches, 3¼ inches, 4 inches and 4⅛ inches respectively. They are interconnected by a plurality of resistors 35, 37, 41 and 43, having values of 154, 249, 374 and 442 ohms, respectively. Each plate section 14***a* and 14*b* is therefore approximately 15½ inches in length. Each of the resistors in each of the parallel plate loading sections, together with 82 ohm resistors 18 and 22 add up to approximately 200 ohms. Together with the inductance in the wire 20, such values are enough to isolate the high frequencies being transmitted by the antenna 10 from being shunt. Therefore, a pulse launched into the horn at the apex travels out of the horn 12 and hits the parallel plates 14. As the pulse meets the parallel plates 14, it also meets the shunt network 16. The net result is that all of energy from the horn is either terminated or radiated so that very little energy is reflected, as shown in FIGS. 5 and 6.

Figure 2:
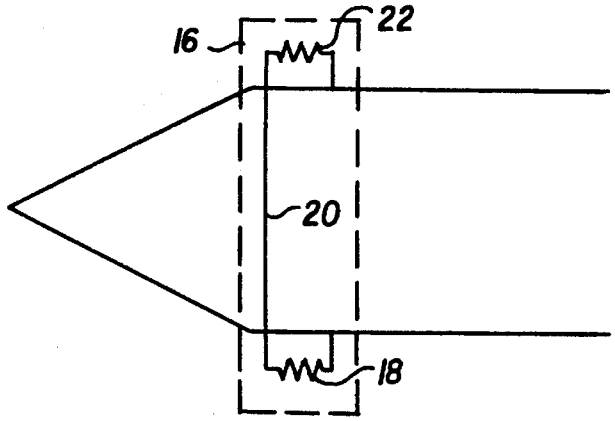
FIG. 2 is a bottom view of the antenna of the present invention shown in FIG. 1.
Figure 3:
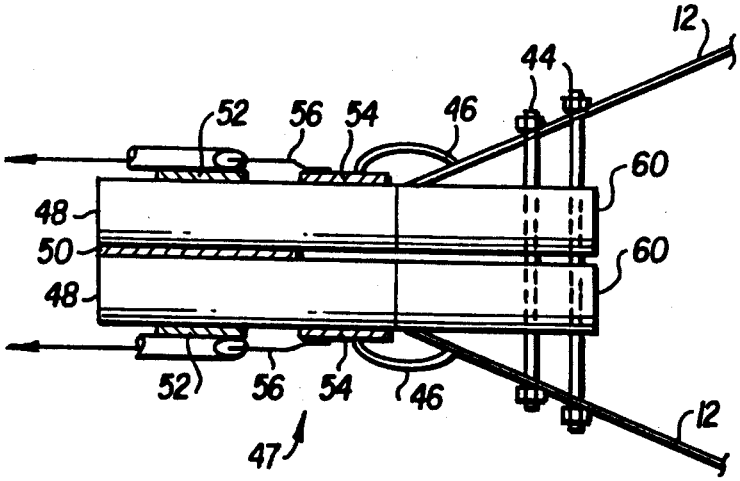
FIG. 3 is a diagram of a top view of a feed for the antenna of FIG. 1.
Figure 4:
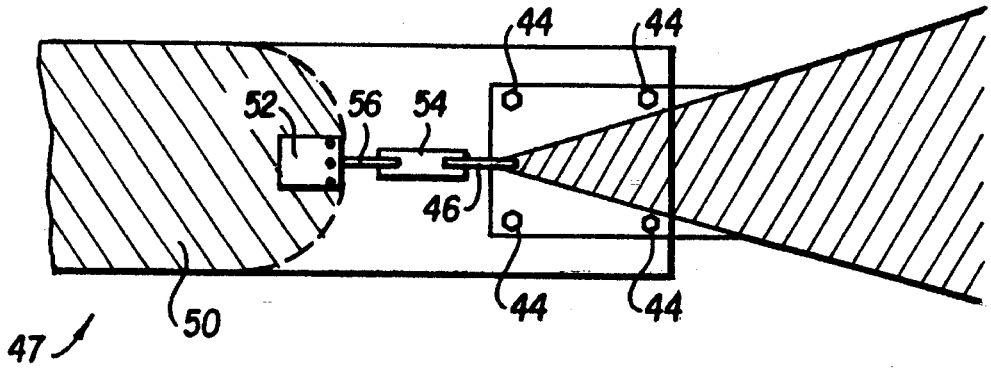
FIG. 4 is a side view of the antenna feed shown in FIG. 2.

Referring now to FIGS. 3 and 4, there is shown a rugged feed 47 which may be utilized with the antenna 10 of the present invention as shown in FIGS. 1 and 2. The rugged feed 47 is constructed from two Teflon printed circuit boards 48 which are placed over an electrically conducting layer 50, such as copper, to form a three-layer board having a ground plane (the layer 50) in the middle. The printed circuit boards 48 may preferably be formed from ⅛ inch Teflon material. A small strip of electrically conducting material 52 is secured to the outboard side of each of the PC boards 48 and is electrically connected to the center ground plane 50. A separate set of contacts 54 is formed by securing two additional pieces of electrically conductive material, such as copper, to the outboard sides of each of the PC boards 48, in close proximity to the TEM horn 12 of the antenna 10. A flexible braid conductor 46 is used to connect each respective side of the TEM horn 12 to a respective contact pad 54. A wire 56 connects each adjacent contact 52 and 54.

The TEM horn portion 12 of the antenna 10 is secured to two Teflon printed circuit boards 60, which may be constructed from the same material as the printed circuit boards 48. Each side of the horn 12 is connected by means of a plurality of bolts 44 which pass through a first side of the horn 12, the first and second printed circuit boards 60 and then the second side of the horn 12 such that the printed circuit boards 60 remain spaced apart while at the same time secure the horn 12 to the two printed circuit boards 60. The two printed circuit boards 60 may be secured to the printed circuit boards 48 by means of glass epoxy or other suitable adhesive.

The rugged feed structure 47, as described above, forms a 200 ohm balanced transmission line which may be connected to a balun (not shown) with which the antenna 10 of the present invention is driven. The flexible braid material 46 may be formed alternatively from copper tape or any other flexible electrically conductive material.

FIG. 5 shows the time domain reflectometer response of the antenna.

FIG. 6 shows a diagram of an S11 return loss versus frequency scan which was generated using a Hewlett Packard 8573 network analyzer. As shown in FIGS. 5 and 6, all of the energy provided to the antenna 10 of the present invention is either terminated or radiated such that very little energy is reflected.

As would be obvious to those of ordinary skill in the art, numerous modifications and variations of the present invention are possible in light of the above teachings. For example, the shunt network 16 as shown in FIG. 1 could be configured with resistor values which are consistent with the TEM horn surge impedance and the loading on the parallel plate section 14 of the antenna 10. The network 16 could, if desired, also be tuned more to an application specific need, such as the specific frequency and bandwidth to be transmitted by the antenna 10 by, for example, constructing the network as a multi-stage lumped element or distributed filter.

Although only a preferred embodiment is specifically illustrated and described herein, it will be appreciated that many modifications and variations of the present invention are possible in light of the above teachings and within the purview of the appended claims without departing from the spirit and intended scope of the invention.

What is claimed is:

1. An antenna for radiating UWB RF pulses, comprising:

a transverse electromagnetic mode antenna having an input end and an output end;

a resistively loaded parallel plate section connected to said output end of said transverse electromagnetic mode antenna;

a shunt network connected between parallel plates of said resistively loaded parallel plate section;

wherein said resistively loaded parallel plate section comprises two sections of parallel plates; and wherein each of said parallel sections of plates is comprised of a plurality of plates having varying widths.

2. The antenna of claim 1, wherein each plate of said plurality of plates is connected to at least one other of said plurality of plates by means of a plurality of resistors.

3. The antenna of claim 1, wherein said shunt network comprises a pair of resistors, each resistor connected to a different side of said parallel plate section and a wire connecting said two resistors.

4. The antenna of claim 1, further including a rugged feed connected to said antenna, comprising:

a first pair of electrically insulating printed circuit boards spaced apart by means of an electrically conductive layer which forms a ground plane;

a first pair of electrically conducting strips, one located on each outboard side of each of said first pair of electrically insulating printed circuit boards, each of said first pair of electrically conducting strips being electrically connected to said electrically conductive layer;

a second pair of electrically conducting strips, one located on each outboard side of each of said first pair of electrically insulating printed circuit boards for forming electrical contacts for said antenna;

an electrical conductor connected between each of said second pair of electrical contacts and a respective side of said transverse electromagnetic mode antenna for driving said antenna;

a second pair of electrically insulating printed circuit boards connected to said first pair of electrically insulating printed circuit boards in a longitudinal parallel direction to said first pair of electrically insulating printed circuit boards; and fixing means for securing said transverse electromagnetic mode antenna to said second pair of electrically insulating printed circuit boards.

5. The antenna of claim 4, wherein said rugged feed forms a 200 ohm balanced transmission line for driving said antenna.

6. A low VSWR high efficiency ultra wide bandwidth antenna for use in transmitting impulse radar signals, comprising:

a transverse electromagnetic mode antenna having an input end and an output end for radiating said impulse radar signals;

two parallel plate sections, each formed of a like plurality of plates of varying widths, connected to said output end of said transverse electromagnetic mode antenna, each of said two parallel plate sections being resistively loaded by a plurality of resistors; and a R-L shunt network connected across said two parallel plate sections, such that said antenna functions to minimize any reflected impulse radar signals.

7. The antenna of claim 6, wherein each plate of said plurality of plates is connected to at least one other of said plurality of plates by means of a plurality of resistors.

8. The antenna of claim 6, wherein said shunt network comprises a pair of resistors, each resistor connected to a different side of said parallel plate section and a wire connecting said two resistors.

9. The antenna of claim 6, further including a rugged feed connected to said antenna, comprising:

a first pair of electrically insulating printed circuit boards spaced apart by means of an electrically conductive layer which forms a ground plane;

a first pair of electrically conducting strips, one located on each outboard side of each of said first pair of electrically insulating printed circuit boards, each of said first pair of electrically conducting strips being electrically connected to said electrically conductive layer;

a second pair of electrically conducting strips, one located on each outboard side of each of said first pair of electrically insulating printed circuit boards for forming electrical contacts for said antenna;

an electrical conductor connected between each of said second pair of electrical contacts and a respective side of said transverse electromagnetic mode antenna for driving said antenna;

a second pair of electrically insulating printed circuit boards connected to said first pair of electrically insulating printed circuit boards in a longitudinal parallel direction to said first pair of electrically insulating printed circuit boards; and fixing means for securing said transverse electromagnetic mode antenna to said second pair of electrically insulating printed circuit boards.

10. The antenna of claim 9, wherein said rugged feed forms a 200 ohm balanced transmission line for driving said antenna.

* * * * *